US010508527B2

(12) United States Patent
Surjaatmadja

(10) Patent No.: US 10,508,527 B2
(45) Date of Patent: Dec. 17, 2019

(54) METHOD FOR CREATING MULTI-DIRECTIONAL BERNOULLI-INDUCED FRACTURES WITH VERTICAL MINI-HOLES IN DEVIATED WELLBORES

(71) Applicant: Halliburton Energy Services, Inc., Houston, TX (US)

(72) Inventor: Jim Basuki Surjaatmadja, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/778,102

(22) PCT Filed: Feb. 16, 2016

(86) PCT No.: PCT/US2016/018075
§ 371 (c)(1),
(2) Date: May 22, 2018

(87) PCT Pub. No.: WO2017/142514
PCT Pub. Date: Aug. 24, 2017

(65) Prior Publication Data

US 2018/0347331 A1 Dec. 6, 2018

(51) Int. Cl.
*E21B 43/26* (2006.01)
*E21B 43/114* (2006.01)

(52) U.S. Cl.
CPC ..... *E21B 43/26* (2013.01); *E21B 43/114* (2013.01)

(58) Field of Classification Search
CPC ..... E21B 43/26; E21B 43/224
USPC ..... 166/308.1
See application file for complete search history.

(56) References Cited

U.S. PATENT DOCUMENTS

| | | | |
|---|---|---|---|
| 5,765,642 | A | 6/1998 | Surjaatmadja |
| 7,580,796 | B2 | 8/2009 | Soliman et al. |
| 7,711,487 | B2 | 5/2010 | Surjaatmadja |
| 7,730,951 | B2 | 6/2010 | Surjaatmadja et al. |
| 7,740,072 | B2 | 6/2010 | Surjaatmadja |
| 8,874,376 | B2 | 10/2014 | Soliman |

(Continued)

OTHER PUBLICATIONS

International Preliminary Report on Patentability issued in related PCT Application No. PCT/US2016/018075 dated Aug. 30, 2018, 14 pages.

(Continued)

*Primary Examiner* — Anna M Momper
*Assistant Examiner* — Patrick F Lambe
(74) *Attorney, Agent, or Firm* — Thomas Rooney; Baker Botts L.L.P.

(57) ABSTRACT

Methods for creating vertical mini-holes in a subterranean formation while creating multi-directional Bernoulli-induced fractures therein are provided. These methods are particularly useful in horizontal or deviated wells. In some embodiments, the method includes forming a mini-hole in the subterranean formation perpendicular to the deviated wellbore. The mini-hole is in fluid communication with the deviated wellbore at a proximal end and has a tip located at a distal end. The method further includes injecting fluid into the mini-hole with a maximum pressure forming at the tip so as to initiate a fracture along local formation stresses proximate the tip of the mini-hole.

22 Claims, 7 Drawing Sheets

(56) References Cited

U.S. PATENT DOCUMENTS

| | | | | |
|---|---|---|---|---|
| 2002/0007949 | A1 | 1/2002 | Tolman et al. | |
| 2008/0078548 | A1* | 4/2008 | Pauls | C09K 8/68 166/280.1 |
| 2009/0283260 | A1 | 11/2009 | Surjaatmadja et al. | |
| 2010/0084134 | A1 | 4/2010 | Tulissi et al. | |

OTHER PUBLICATIONS

Abass, Hazim Hussein, et al. "Oriented fracturing: A new technique to hydraulically fracture an openhole horizontal well." SPE Annual Technical Conference and Exhibition. Society of Petroleum Engineers, 2009.

International Search Report and Written Opinion issued in related PCT Application No. PCT/US2016/018075 dated Nov. 4, 2016, 18 pages.

* cited by examiner

METHOD FOR CREATING MULTI-DIRECTIONAL BERNOULLI-INDUCED FRACTURES WITH VERTICAL MINI-HOLES IN DEVIATED WELLBORES

CROSS-REFERENCE TO RELATED APPLICATION

The present application is a U.S. National Stage Application of International Application No. PCT/US2016/018075 filed Feb. 16, 2016, which is incorporated herein by reference in its entirety for all purposes.

TECHNICAL FIELD

The present disclosure relates generally to fracturing subterranean formations to enhance oil and gas production therefrom, and more particularly, to improved techniques for fracturing horizontal or deviated wellbores in subterranean formations.

BACKGROUND

Oil and gas wells are drilled to produce hydrocarbons from subterranean formations. In recent years, the efficiency of such wells has been improved through recent improvements in fracturing techniques. Fracturing is a process whereby cracks or fissures known as fractures are created in the subterranean formation to enhance the pathways through which the hydrocarbons flow to the oil and gas wells drilled into the formations. Periodically, it is desired to add additional fractures to an already-fractured subterranean formation. For example, additional fracturing may be desired for a previously producing well that has been damaged due to factors such as fine migration. Although the existing fractures may still exist, they have been no longer effective, or less effective. In such a situation, stress caused by the first fracture continues to exist, but it would not significantly contribute to production. In another example, multiple fractures may be desired to increase reservoir production. This scenario may be also used to improve sweep efficiency for enhanced recovery wells such as water flooding steam injection, etc. In yet another example, additional fractures may be created to inject with drill cuttings.

Conventional methods for initiating additional fractures typically induce the additional fractures with near-identical angular orientation to previous fractures. While such methods increase the number of locations for drainage into the wellbore, they may not introduce new directions for hydrocarbons to flow into the wellbore. Conventional methods may also not account for, or even more so, utilize, stress alterations around existing fractures when inducing new fractures.

Creating fractures in horizontal or deviated wells has its own set of challenges. In order to place the most effective fractures in a horizontal well, fractures must be placed transversely in order to drain a much larger formation area. A longitudinal fracture would only drain the similar area slightly more effectively, thus creating a rapid increase of production followed by a rapid production decrease. Essentially, for best drainage of the reservoir, the ideal placement of fractures is generally considered to be radially and generally perpendicular to the horizontal or deviated wellbore. However, radial drainage through these fractures causes severe choking, hence reducing the potential for rapid production during the initial production stages. Other approaches involve creating a fracture that initiates longitudinally, then bending into the natural fracture direction after the fracture extended past the near wellbore stress field influenced region. As the fracture faces move left and right, the longitudinal fracture does not open widely, causing a constriction—a typical characteristic of tortuosity issues. When the natural fracture direction is greater than 30-40 degrees from the wellbore, the fracture tends to rapidly twist and produce multiple, short and narrow fractures. These fractures are narrow as they compete with each other for the fracturing fluid, and therefore, this situation often results in premature screen outs.

When hydra jet assist fracturing methods are used to create transverse fractures, in general, a fracture can be initiated perpendicular to the wellbore (or wherever the jets are directed) and then the fracture will bend into the natural direction of the fracture (unless sophisticated instruments direct the jets towards the natural plane). This generally does not cause tortuosity or screen out issues, as the hydra jet tool will scour the formation face large enough to eliminate tortuosity effects. However, radial inflow to the wellbore constricts production flow, even with this approach.

Accordingly, a need exists for an improved method for initiating multiple fractures in a horizontal or deviated wellbore, where the method accounts for tangential forces around a the wellbore and minimizes constriction of the production flow into the wellbore.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The present invention relates generally to methods, systems, and apparatus for inducing fractures in a subterranean formation and more particularly to methods and apparatus to place a first fracture with a first orientation in a formation followed by a second fracture with a second angular orientation in the formation. Furthermore, the present invention may be used on cased well bores or open holes.

The methods and apparatus of the present invention may allow for increased well productivity by the introduction of multiple fractures introduced at different angles relative to one another in a wellbore.

Figure 1:
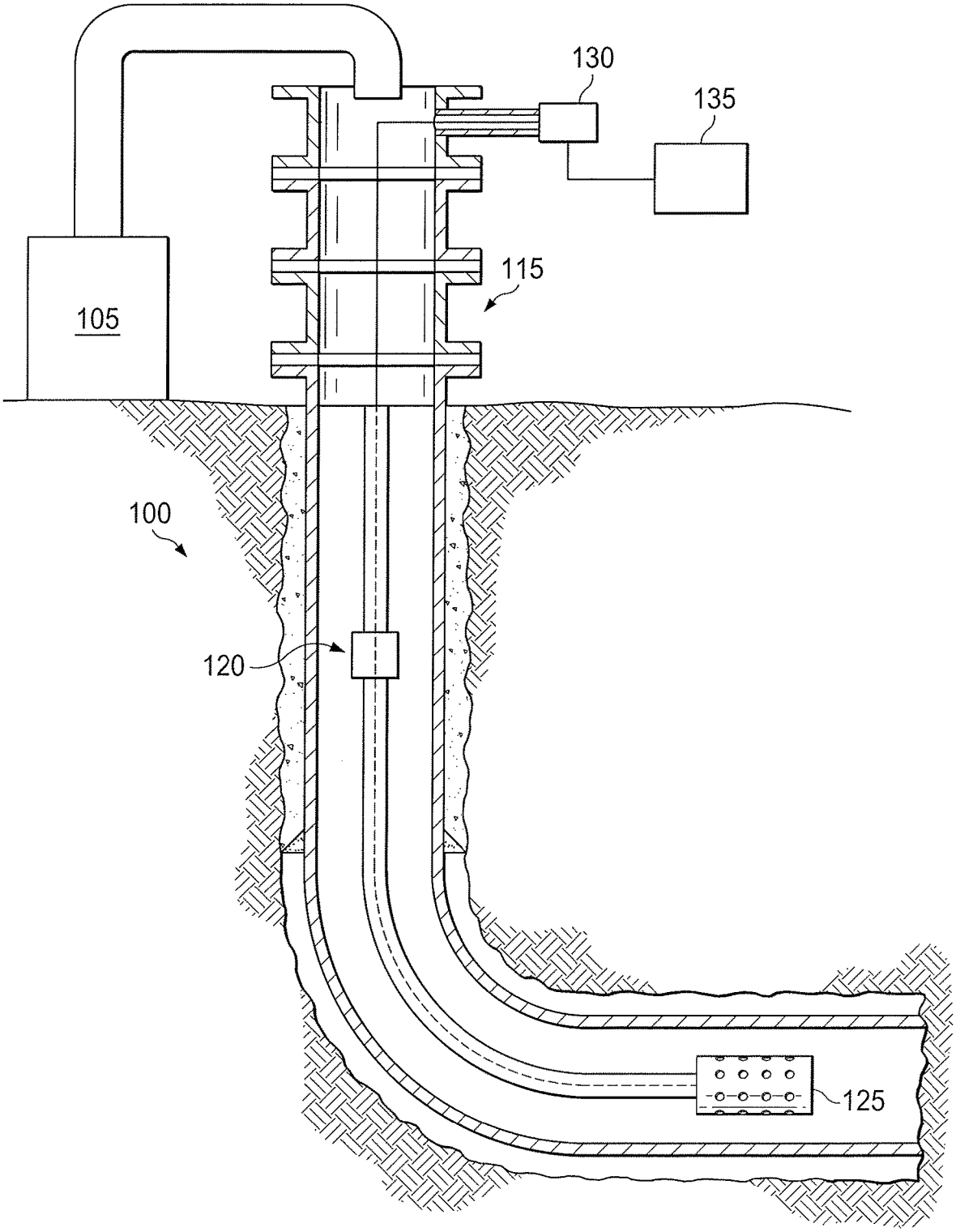
FIG. 1 is a schematic block diagram of a wellbore and a system for fracturing.

FIG. 1 depicts a schematic representation of a subterranean well bore 100 through which a fluid may be injected into a region of the subterranean formation surrounding well bore 100. The fluid may be of any composition suitable for the particular injection operation to be performed. For example, where the methods of the present invention are used in accordance with a fracture stimulation treatment, a fracturing fluid may be injected into a subterranean formation such that a fracture is created or extended in a region of the formation surrounding well bore 100 and generates pressure signals. The fluid may be injected by injection device 105 (e.g., a pump). At wellhead 115, a downhole conveyance device 120 is used to deliver and position a fracturing tool 125 to a location in the wellbore 100. In some example implementations, the downhole conveyance device 120 may include coiled tubing. In other example implementations, downhole conveyance device 120 may include a drill string that is capable of both moving the fracturing tool 125 along the wellbore 100 and rotating the fracturing tool 125. The downhole conveyance device 120 may be driven by a drive mechanism 130. One or more sensors may be affixed to the downhole conveyance device 120 and configured to send signals to a control unit 135. The control unit 135 is coupled to drive unit 130 to control the operation of the drive unit. The control unit 135 is coupled to the injection device 105 to control the injection of fluid into the wellbore 100. The control unit 135 includes one or more processors and associated data storage. The fracturing tool 125 may be a hydra jetting tool, e.g., the hydra jetting tool(s) used in Halliburton's SurgiFrac® Fracturing Service.

Figure 2A:
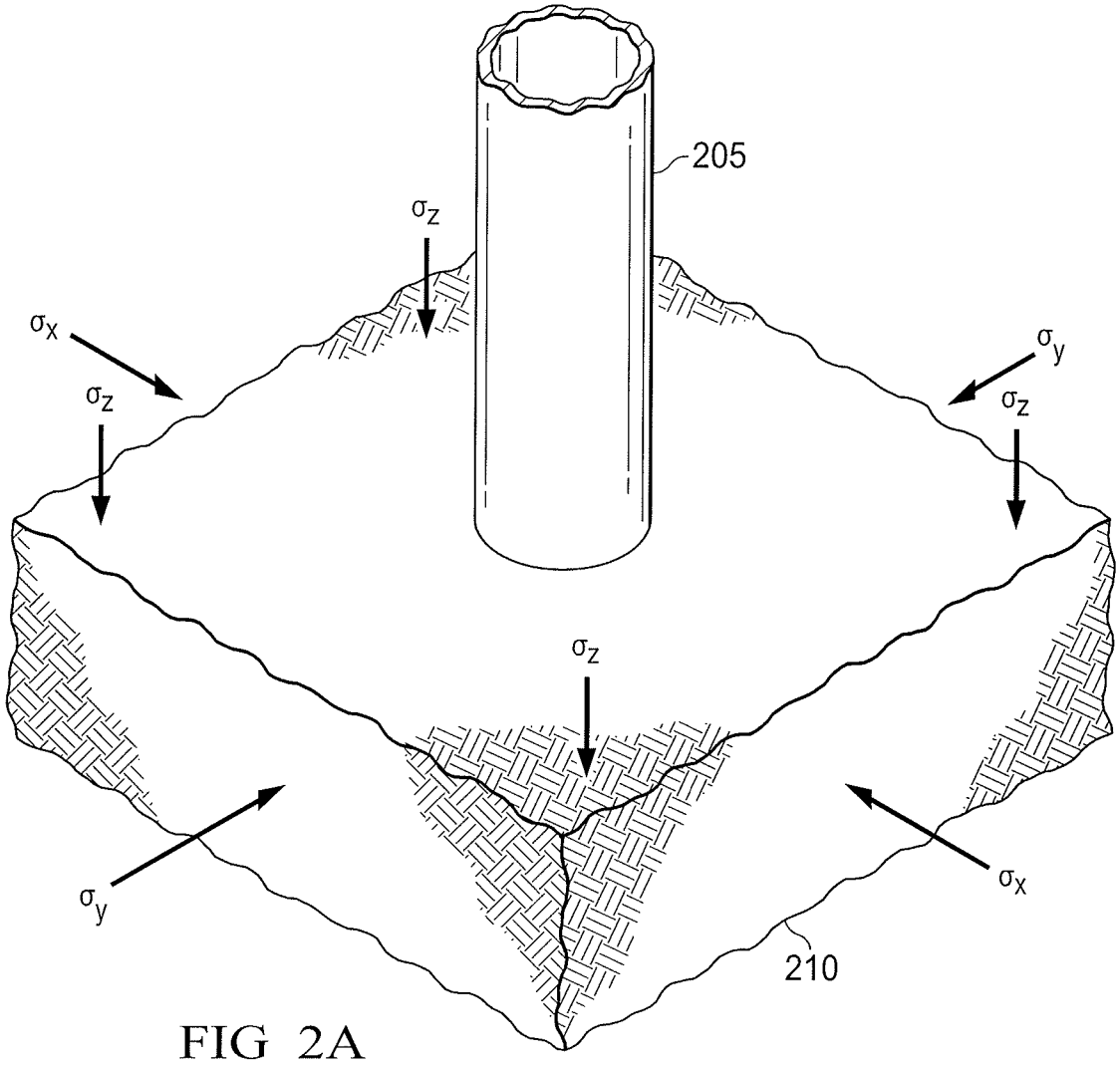
FIG. 2A is a graphical representation of a wellbore in a subterranean formation and the principal stresses on the formation.

FIG. 2A is an illustration of a wellbore 205 passing through a formation 210 and the stresses on the formation. In general, formation rock is subjected by the weight of anything above it, i.e. $\sigma_z$ overburden stresses. By Poisson's rule, these stresses and formation pressure effects translate into horizontal stresses $\sigma_x$ and $\sigma_y$. In general, however, Poisson's ratio is not consistent due to the randomness of the rock. Also, geological features, such as formation dipping may cause other stresses. Therefore, in most cases, $\sigma_x$ and $\sigma_y$ are different.

Figure 2B:
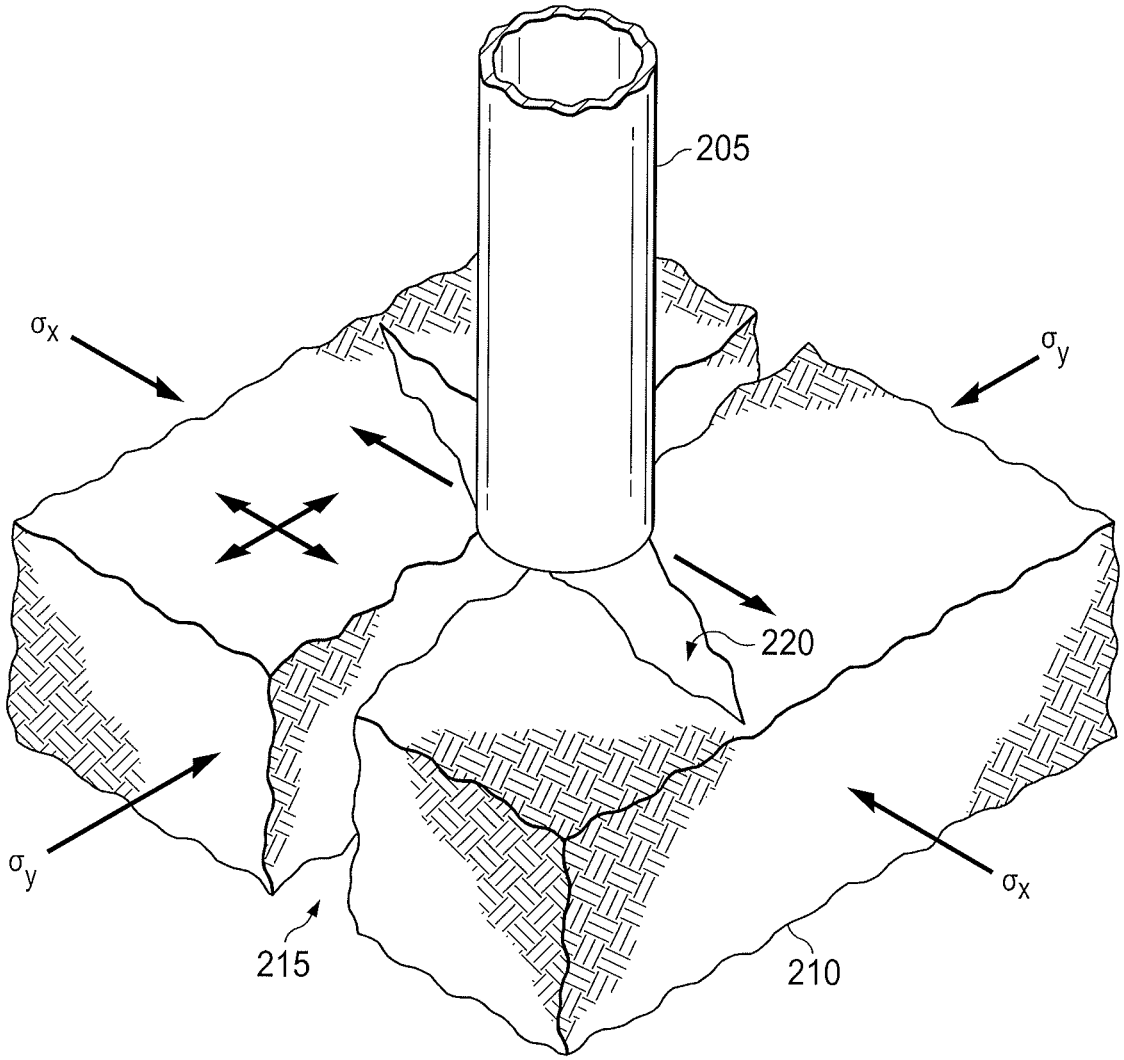
FIG. 2B is a graphical representation of a wellbore in a subterranean formation that has been fractured and the principal stresses on the formation.

FIG. 2B is an illustration of the wellbore 205 passing though the formation 210 after which a fracture 215 is induced in the formation 210. Assuming for this example that $\sigma_x$ is smaller than $\sigma_y$, the fracture 215 will extend into the y direction. After the local stresses have been modified as discussed in FIG. 6 (i.e. $\sigma_x$ becomes larger than $\sigma_y$), another fracture 220 is oriented in the x direction. As used herein, the orientation of the second fracture is defined to be a vector perpendicular to the fracture plane.

As fracture 215 opens fracture faces to be pushed in the x direction. Because formation boundaries cannot move, the rock becomes more compressed, increasing $\sigma_x$. Over time, the fracture will tend to close as the rock moves back to its original shape due to the increased $\sigma_x$. While the fracture is closing however, the stresses in the formation will cause a subsequent fracture to propagate in a new direction shown by projected fracture 220.

Figure 3:
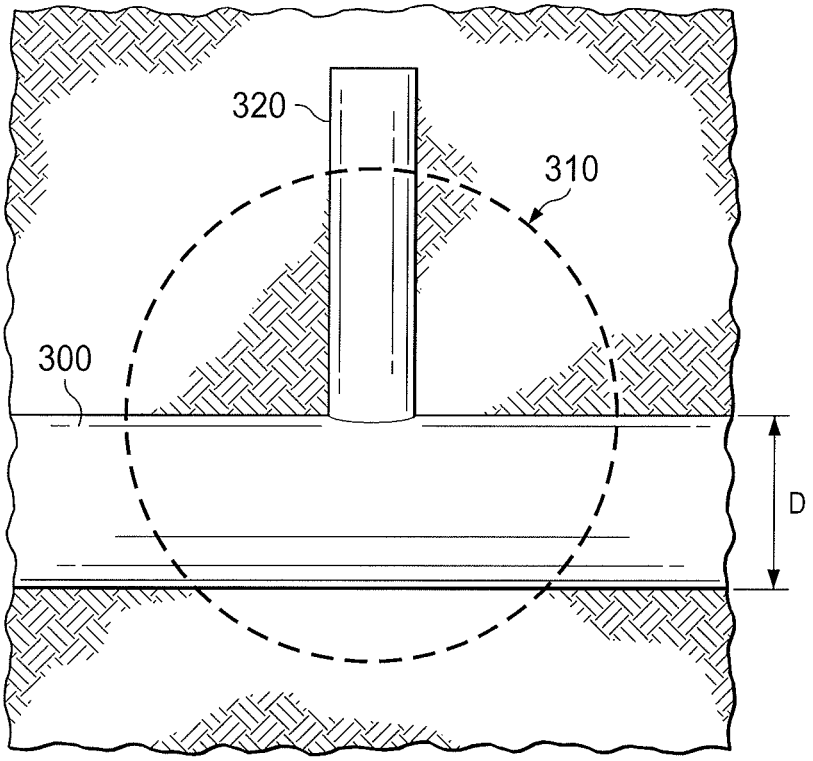
FIG. 3 is a graphical representation of a horizontal wellbore in a subterranean formation having a vertical mini-hole and associated fracture formed therein.

In a horizontal wellbore 300 having diameter D and pressurized to a pressure P, the position of the fracture 310 can be proven to follow along the wellbore, as shown in FIG. 3. In essence, the wellbore presence creates a stress pattern that follows a "near wellbore effect", i.e., where stresses are generally small towards the wellbore. In past experiences, before the industry ventured into lateral (or near horizontal) completions, wells are vertical, and since fractures are almost always vertical, fractures are always placed properly, directed towards the maximum stress direction. In a horizontal wellbore 300, however, wells are generally not drilled into the maximum stress direction. This means, that in most cases, having a fracture to initiate following the wellbore is not desired, as it will twist to conform with the natural stress field; which causes tortuous fracture paths that often leads to premature screen outs. This is even more so if there were a large vertical hole formed in it, with each hole complementing each other to form the vertical fracture 310. Small perforations spaced evenly along the wellbore (such as 6 ppf) have proven to produce similar effects. It was later found, that better results were obtained if the perforations were placed in a very short section of the well; thus maybe creating many small fractures that congregate into one large fracture.

Figure 4:
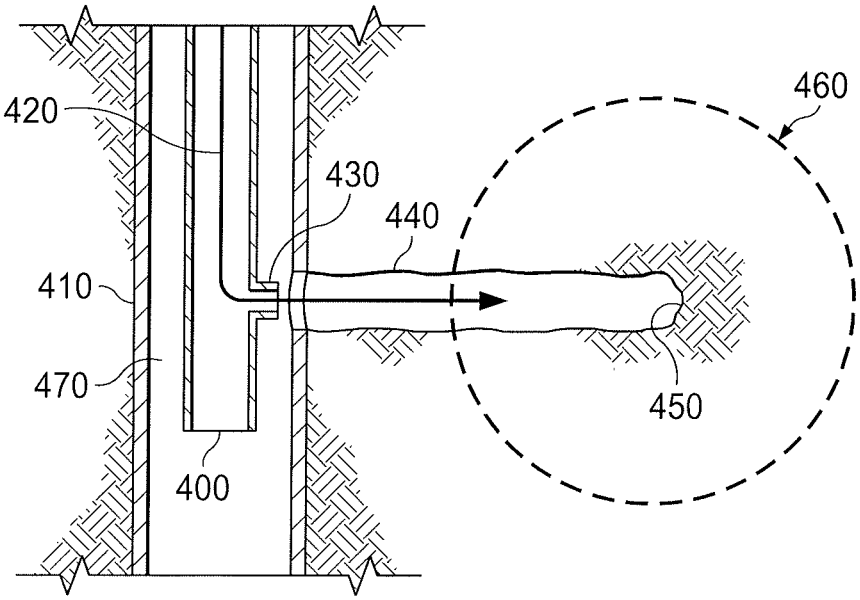
FIG. 4 is a graphical representation of a horizontal wellbore (shown vertically oriented in the drawing) and an associated vertical mini-bore, which illustrates the effects of the Bernoulli principle applied to the generation of a fraction in accordance with the present disclosure.
Figure 5:
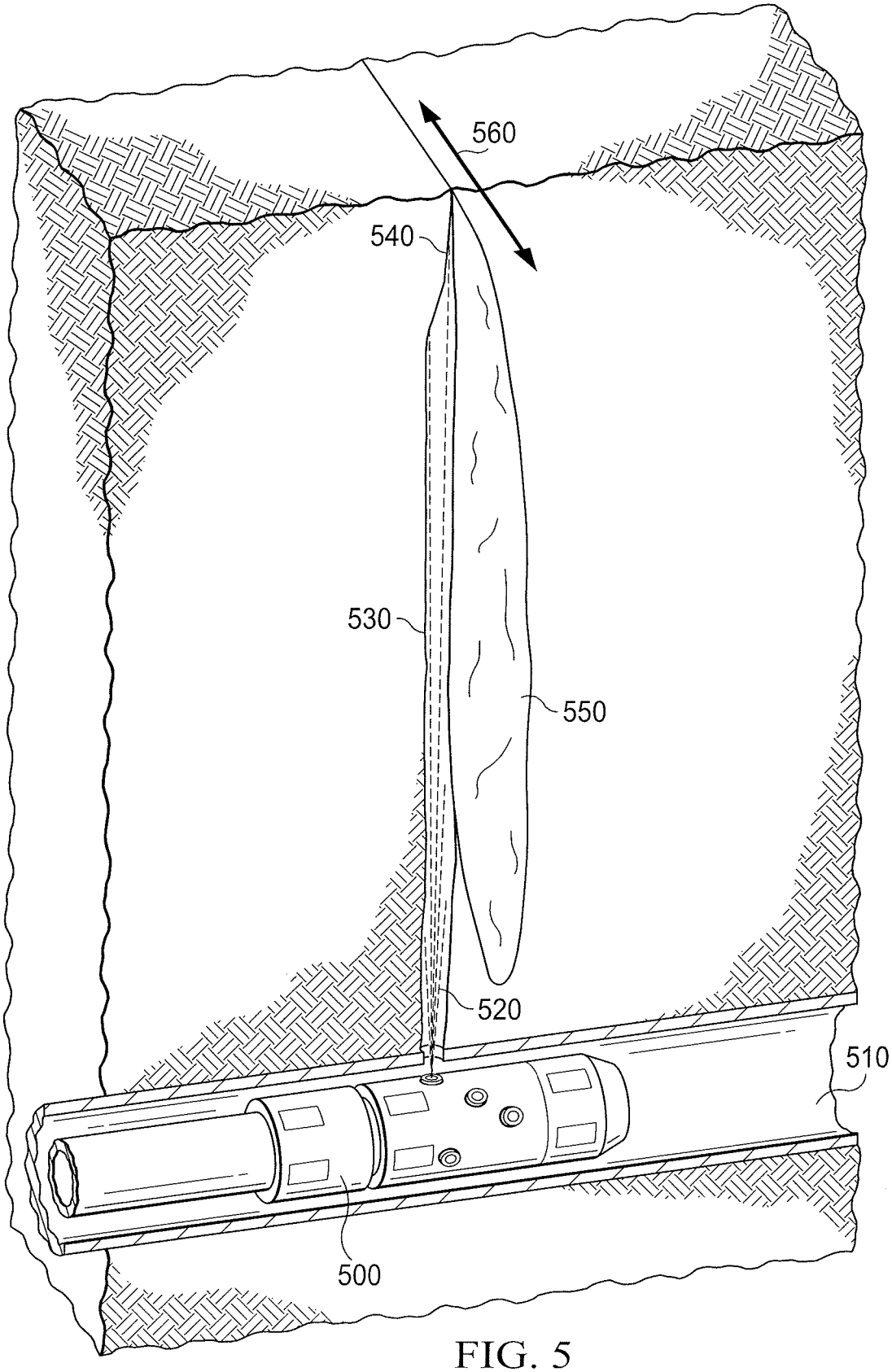
FIG. 5 is a graphical representation of a fracture initiation from a vertical mini-hole formed in a horizontal wellbore using the Bernoulli principle in accordance with the presentation disclosure.
Figure 6:
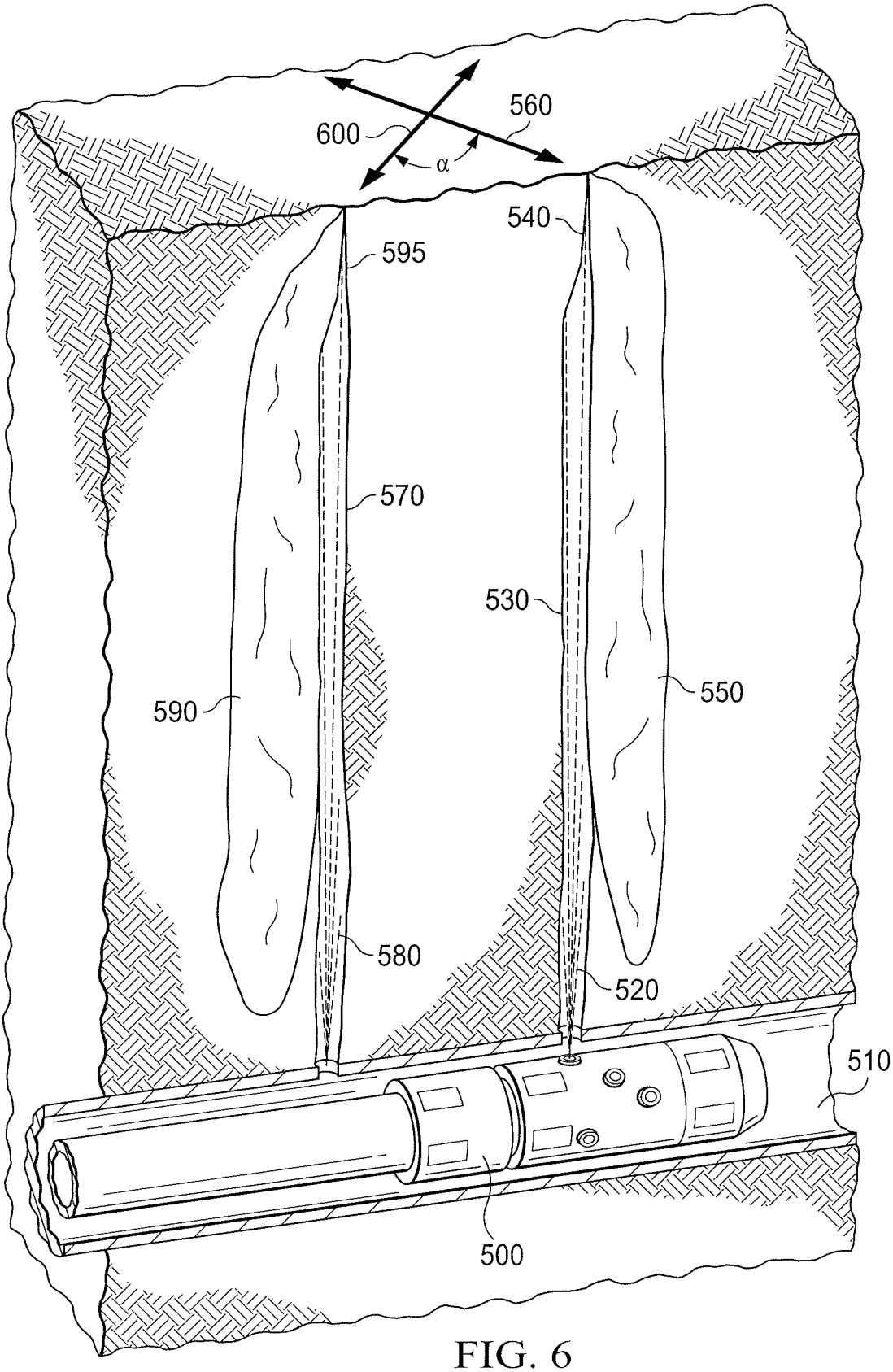
FIG. 6 is a graphical representation of multi-oriented fractures initiated from two parallel vertical mini-holes formed in a horizontal wellbore using the Bernoulli principle in accordance with the present disclosure.

The approach of the present disclosure is to create one or more vertical wellbores along the main horizontal or deviated wellbore. Vertical wells have been fracture stimulated since the early 1900's with great success. The approach is that by creating a large diameter, long, vertical perforation from the horizontal wellbore, then it can become in effect a vertical well. This means that fractures will be aligned with this "wellbore" much in the same way they have in all of the vertical wells formed since the 1900's. Fractures were thought to initiate into the desired direction. What was forgotten is that pressurization-to-frac was administered through the horizontal well. This means, that if the horizontal well was cased and properly cemented, the assumption above would be correct. But, if the well is uncemented, i.e., openhole or has an uncemented liner, or even cemented but improperly done, then fracture direction is initially influenced by the cross bore between the two boreholes. This means that most probably, with a large vertical mini-hole 320 as seen in FIG. 3, the fracture 310 will initiate longitudinally which is, in general, not desired in horizontal wells. This is because horizontal wells are usually placed in relatively thin reservoirs. In such situations, after the fracture is formed, production would increase substantially, but then drop rapidly to an unacceptable production level. The reason is that the created fracture did not increase the drainage area into the well; hence it quickly depletes the reservoir area above and below the wellbore 300. Increasing the fracture size will also create tortuosities as discussed earlier The present disclosure makes use of the Bernoulli energy relationship to form a fracture at the end of the one or more mini-holes formed in the horizontal or deviated wellbore. By doing so, the fracture extends into the local maximum stress direction, totally uninfluenced by the stress cage that is mainly influenced by the near wellbore stresses. The Bernoulli induced fracture is better explained with reference to FIG. 4. FIG. 4 illustrates a tubing string 400, which is disposed within a casing liner 410 or alternatively in an open hole. Pressurized fluid 420 from the pumps 105 at the surface is pumped into the tubing string 400 at a high pressure, e.g., 8800 psi. Assuming that the annulus 470 is pressured primarily by the hydrostatic fluid weight (for a 10,000 ft well, this is approximately 5000 psi), the pressurized fluid 420 is then accelerated through nozzle 430, which is formed within the tubing string 400. As the fluid 420 passes through the nozzle 430, it is then accelerated along the path of the mini-hole 440 all away to the tip of the mini-hole. Also, in the first part of the fluid path, the pressure drops from roughly 8,800 psi in the tubing string 400 to about 6,000 psi in the nozzle 430 to approximately 5000 psi; where the fluid is accelerated to a velocity higher than 550 ft/sec. Because of this high velocity, the fluid surrounding the jet is rapidly pulled into it, causing a low pressure that could be approximately 4,800 psi or much less along the first third or so of the mini-hole 440. As the fluid approaches the tip 450 of the mini-hole 440, the Bernoulli effect principle comes into play causing the pressure to increase again to approximately 7,000 psi about ⅔rds away along the mini-hole 440 and then to approximately 7,800 psi near the tip 450 to approximately 8,000 psi right at the tip. This high pressure at the tip will cause the rock formation at the tip 450 to fracture, while the rock surrounding the base of the mini-hole near 430 and hole 410 stays intact as the pressure there stays at 4000-4800 psi. Once the pressurized fluid exits the tip 450 of the mini-hole 440 it forms a fracture 460, which is oriented at an angle to an axis of the mini-hole 440, as best seen in FIGS. 5 & 6. The fracture 460 initiates from this spot, i.e., the tip of the formation. The direction is uninfluenced by the wellbore 470, since 470 is de-pressurized less than the hydrostatic, and hence, the fracture direction will just follow the local maximum stress direction.

Turning to FIG. 5, a hydra-jetting tool 500 is shown disposed in horizontal or deviated wellbore 510. The hydra jetting tool 500 creates a high pressure jet 520, which is directed into a vertically formed mini-hole 530, which in turn may have been formed by the hydra-jetting tool 520. The fluid pressure increases at the tip 540 of the mini-hole 530 in accordance with the Bernoulli principle. This increased pressure initiates the fracture 550, along the direction indicated by the double arrow 560. In this embodiment, a single mini-hole 530 with an associated single fracture 550. The fracture is created in a plane which forms an angle with a longitudinal axis of the mini-hole 530. In accordance with the present disclosure, the fracture 550 will follow the local maximum stress direction as explained above.

In another alternative embodiment, two parallel vertical mini-holes 530 and 570 are formed in the horizontal wellbore 510, as shown in FIG. 6. In this embodiment, a second high pressure jet 580 is injected into the second vertical mini-hole 570, which forms a second fracture 590, which is initiated at a tip 595 in the second mini-hole 570. The second fracture follows a second direction, which is shown by the second set of double arrows 600. The two fractures 560 and 600 are oriented at an angle $\alpha$ to each other. The angle $\alpha$ may be approximately 60-120 degrees. This angle is caused by a stress anisotropy reversal or modification caused by the first fracture 550. As fracture 550 is created, the fracture faces compresses the rock near mini-hole 570; which will reverse the stresses—e.g. the previous minimum stress rock is compressed as such that the local stresses in that direction is increased to a point that it becomes the maximum stress. If fracture 590 is immediately created, arrow 600 would be 90 degrees away from the arrow 560. After a longer time has expired, this direction will rotate back slowly to its original state; meaning arrow 590 will eventually be parallel to arrow 560. Like the first fracture 560, the second fracture 600 will follow the local maximum stress direction and thereby facilitate the flow of hydrocarbons into the mini-hole 570 and back into the horizontal wellbore 510.

Figure 7:
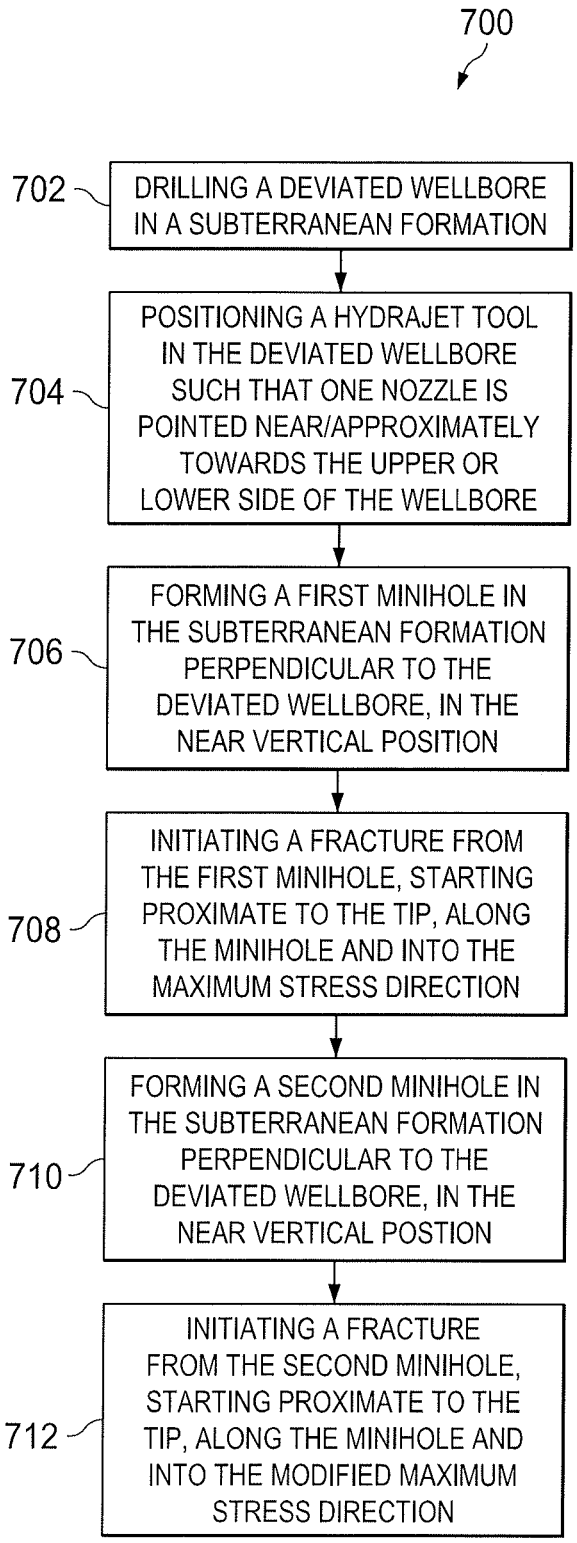
FIG. 7 is a process flow chart illustrating a method of forming subterranean fractures in accordance with the present disclosure.

Turning to FIG. 7 a process flow chart is provided which illustrates the method of forming subterranean fractures proximate a horizontal or deviated wellbore and producing hydrocarbons from the subterranean formation through that wellbore in accordance with the present disclosure is illustrated generally by reference numeral 700. The method includes drilling a deviated wellbore into the subterranean formation (box 702). It also may include positioning a hydra-jetting tool into the deviated wellbore with the jets aligned so as to get vertically (box 704). The method 700 may further include forming a first mini-hole in the subterranean formation perpendicular to the deviated wellbore in the near vertical position using the hydra-jetting tool (box 706). As those of ordinary skill in the art will appreciate, the first mini-hole may be formed by other techniques than through use of a hydra-jetting tool. The first mini-hole is formed in fluid communication with the deviated wellbore at a proximal end and has a tip located at a distal end. The method 700 further includes initiating a fracture from the first mini-hole, starting proximate to the tip, along the mini-hole and in the maximum stress direction (box 708).

The method 700 may optionally further include forming a second mini-hole in the subterranean formation perpendicular to the deviated wellbore in the near vertical position (box 710), using the hydra-jetting tool or other known techniques. The second mini-hole is formed in fluid communication with the deviated wellbore at a proximal end and has a tip located at a distal end. The method 700 further includes initiating a fracture from the second mini-hole, starting proximate to the tip, along the mini-hole and into the modified maximum stress direction (box 712).

In one embodiment, the first and second mini-holes are formed at the same time using in-line positioned jet nozzles and by injecting fluid into the first and second mini-holes with a maximum pressure forming at the tips of the first and second mini-holes so as to initiate fractures along local formation stresses proximate the tips of the first and second mini-holes. In one exemplary embodiment, the deviated wellbore may comprise one or more horizontal wellbores and the first and second mini-holes are vertically oriented.

In one embodiment of the method 700, the first and second mini-holes are formed using a hydra-jetting tool having a nozzle having a diameter of approximately 0.35 inches or greater. The fractures that are initiated are formed from a Bernoulli-induced pressure. The pressure of fluid injected by the hydra-jetting tool to form the mini-hole may be approximately 3,000 to 5,000 psi. In another embodiment, the fractures that are formed are multi-oriented fractures, with the fracture formed proximate the first mini-hole being formed at an angle to the fracture formed proximate the second mini-hole.

Although the present disclosure and its advantages have been described in detail, it should be understood that various changes, substitutions and alterations can be made herein without departing from the spirit and scope of the disclosure as defined by the following claims.

What is claimed is:

1. A method of producing hydrocarbons from a subterranean formation, comprising:

drilling a deviated wellbore into the subterranean formation;

positioning a hydra-jetting tool into the deviated wellbore;

forming a mini-hole in the subterranean formation perpendicular to the deviated wellbore using the hydra-jetting tool, the mini-hole being in fluid communication with the deviated wellbore at a proximal end and having a tip located at a distal end; and injecting fluid into the mini-hole with a maximum pressure forming at the tip so as to initiate a fracture along local formation stresses proximate the tip of the mini-hole.

2. The method of claim 1, wherein the deviated wellbore comprises a horizontal wellbore and the mini-hole is vertically oriented.

3. The method of claim 1, wherein the deviated wellbore comprises a horizontal wellbore and the mini-hole is positioned in two directions, opposing to each other.

4. The method of claim 1, wherein the hydra-jetting tool injects the fluid into the mini-hole to initiate the fracture.

5. The method of claim 1, wherein the mini-hole is formed using a hydra-jetting tool having a nozzle having a diameter of approximately 0.35 inches or greater.

6. The method of claim 1, wherein the fracture that is initiated is formed from a Bernoulli-induced pressure.

7. The method of claim 1, wherein the pressure of fluid injected by the hydra-jetting tool to form the mini-hole is approximately 3,000 to 10,000 psi or more.

8. A method of producing hydrocarbons from a subterranean formation, comprising:

drilling a deviated wellbore into the subterranean formation;

positioning a hydra-jetting tool into the deviated wellbore;

forming a first mini-hole in the subterranean formation perpendicular to the deviated wellbore using the hydra-jetting tool, the mini-hole being in fluid communication with the deviated wellbore at a proximal end and having a tip located at a distal end;

forming a second mini-hole in the subterranean formation perpendicular to the deviated wellbore using the hydra-jetting tool, the mini-hole being in fluid communication with the deviated wellbore at a proximal end and having a tip located at a distal end; and injecting fluid into the first and second mini-holes with a maximum pressure forming at the tips of the first and second mini-holes so as to initiate fractures along local formation stresses proximate the tips of the first and second mini-holes.

9. The method of claim 8, wherein the first and second mini-holes are formed at the same time using in-line positioned jet nozzles and by injecting fluid into the first and second mini-holes with a maximum pressure forming at the tips of the first and second mini-holes so as to initiate fractures along local formation stresses proximate the tips of the first and second mini-holes.

10. The method of claim 8, wherein the deviated wellbore comprises a horizontal wellbore and the first and second mini-holes are vertically oriented.

11. The method of claim 8, wherein the hydra-jetting tool injects the fluid into the first and second mini-holes to initial the fractures.

12. The method of claim 8, wherein the first and second mini-holes are formed using a hydra-jetting tool having a nozzle having a diameter of approximately 0.35 inches or greater.

13. The method of claim 8, wherein the fractures that are initiated are formed from a Bernoulli-induced pressure.

14. The method of claim 8, wherein the pressure of fluid injected by the hydra-jetting tool to form the mini-hole is approximately 3,000 to 10,000 psi or more.

15. The method of claim 8, wherein the fractures that are formed are multi-oriented fractures, with the fracture formed proximate the first mini-hole being formed at an angle to the fracture formed proximate the second mini-hole.

16. A method of fracturing a subterranean formation having a deviated wellbore formed therein, comprising:

forming a mini-hole in the subterranean formation perpendicular to the deviated wellbore, the mini-hole being in fluid communication with the deviated wellbore at a proximal end and having a tip located at a distal end; and injecting fluid into the mini-hole with a maximum pressure forming at the tip so as to initiate a fracture along local formation stresses proximate the tip of the mini-hole.

17. The method of claim 16, further comprising forming a second mini-hole in the subterranean formation perpendicular to the deviated wellbore and generally parallel to the first mini-hole, the second mini-hole being in fluid communication with the deviated wellbore at a proximal end and having a tip located at a distal end; and injecting fluid into the second mini-hole with a maximum pressure forming at the tip so as to initiate a fracture along local formation stresses proximate the tip of the second mini-hole.

18. The method of claim 17, wherein the fractures that are formed are multi-oriented fractures, with the fracture formed proximate the first mini-hole being formed at an angle to the fracture formed proximate the second mini-hole.

19. The method of claim 17, wherein a hydra-jetting tool forms the first and second mini-holes and injects the fluid into the first and second mini-holes to initiate the fractures.

20. The method of claim 19, wherein the fractures that are initiated are formed from a Bernoulli-induced pressure.

21. The method of claim 17, wherein the first and second mini-holes are formed using a hydra-jetting tool having a nozzle having a diameter of approximately 0.35 inches or greater.

22. The method of claim 21, wherein the pressure of fluid injected by the hydra-jetting tool to form the first and second mini-holes is approximately 3,000 to 10,000 psi or more.

* * * * *